US007261333B2

(12) United States Patent
Tomaszewski

(10) Patent No.: US 7,261,333 B2
(45) Date of Patent: Aug. 28, 2007

(54) POWER ACTUATOR FOR DOOR LATCH

(75) Inventor: Kris Tomaszewski, Newmarket (CA)

(73) Assignee: Intier Automotive Closures Inc., Newmarket, Ontario (CA)

( * ) Notice: Subject to any disclaimer, the term of this patent is extended or adjusted under 35 U.S.C. 154(b) by 53 days.

(21) Appl. No.: 10/525,084

(22) PCT Filed: Aug. 20, 2003

(86) PCT No.: PCT/CA04/01240

§ 371 (c)(1),
(2), (4) Date: Feb. 22, 2005

(87) PCT Pub. No.: WO2004/018808

PCT Pub. Date: Mar. 4, 2004

(65) Prior Publication Data

US 2006/0131893 A1 Jun. 22, 2006

(51) Int. Cl.
*E05C 3/06* (2006.01)
*E05C 3/16* (2006.01)

(52) U.S. Cl. ..... 292/201; 292/216; 292/252; 292/DIG. 23

(58) Field of Classification Search ..... 292/201, 292/216, DIG. 23, 252
See application file for complete search history.

(56) References Cited

U.S. PATENT DOCUMENTS 4,518,181 A * 5/1985 Yamada ..... 292/201
4,793,640 A * 12/1988 Stewart, Sr. ..... 292/201
5,453,671 A * 9/1995 Baier et al. ..... 318/466
5,634,677 A 6/1997 Buscher et al.
5,697,237 A * 12/1997 Dilger et al. ..... 70/264
5,934,717 A 8/1999 Wirths et al.
5,951,070 A 9/1999 Spurr
5,961,163 A 10/1999 Brackmann et al.
5,997,055 A 12/1999 Strathmann
6,076,868 A 6/2000 Roger, Jr. et al.
6,155,124 A 12/2000 Wirths
6,278,252 B1 * 8/2001 Kachouh ..... 318/466
6,536,814 B2 * 3/2003 Kachouh ..... 292/216

(Continued)

FOREIGN PATENT DOCUMENTS

DE 44 47 687 9/1994

(Continued)

*Primary Examiner*—Carlos Lugo
(74) *Attorney, Agent, or Firm*—Clark Hill PLC

(57) ABSTRACT

A power actuator assembly for a latch includes first and second articulated levers. The first lever includes cam follower surfaces and the second lever includes at least one stop member which pivots between first and second positions as each lever travels between first and second positions. A motor-driven cam having driving members and stop members drives the first lever. More particularly, each driving member has a path of travel that engages one of the cam follower surfaces for a portion of the travel path to drive the first and second levers and is in disengaging alignment with the cam follower for another portion of travel. The cam stop members abut the stop member of the second lever when the cam driving members are in the non-aligned position, whereby the levers may be activated without driving the cam. The assembly can be employed, inter alia, in a lock application or a power release application so as to preclude the necessity of having to backdrive the power actuator.

8 Claims, 5 Drawing Sheets

U.S. PATENT DOCUMENTS

| | | | | |
|---|---|---|---|---|
| 6,712,407 | B2 * | 3/2004 | Duriez | 292/201 |
| 2006/0043740 | A1 * | 3/2006 | Torkowski et al. | 292/201 |

FOREIGN PATENT DOCUMENTS

| | | |
|---|---|---|
| DE | 19530 722 | 2/1997 |
| DE | 1 9713864 | 10/1998 |
| DE | 1 178 172 | 2/2002 |
| EP | 1 061 212 | 12/2000 |
| EP | 1 149 970 | 10/2001 |

* cited by examiner

FIG. 2A.
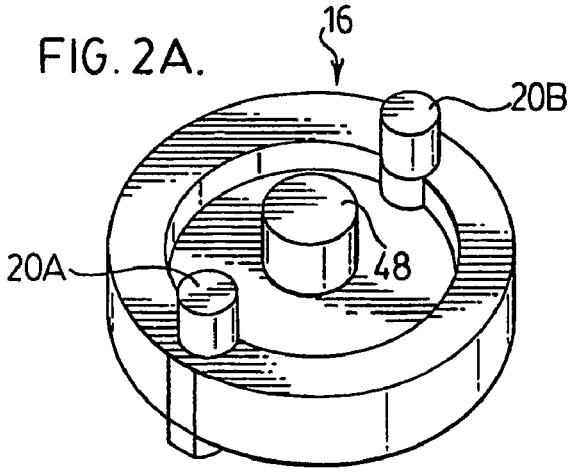
FIG. 2B.
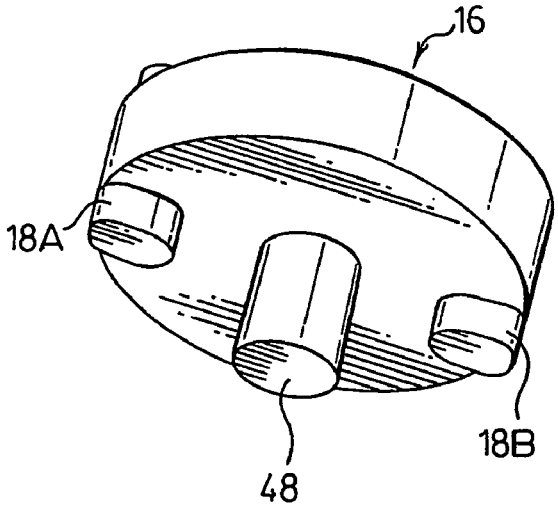
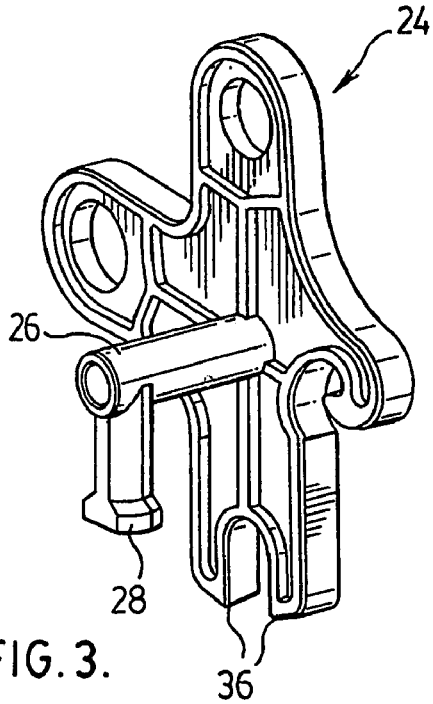
FIG. 3.
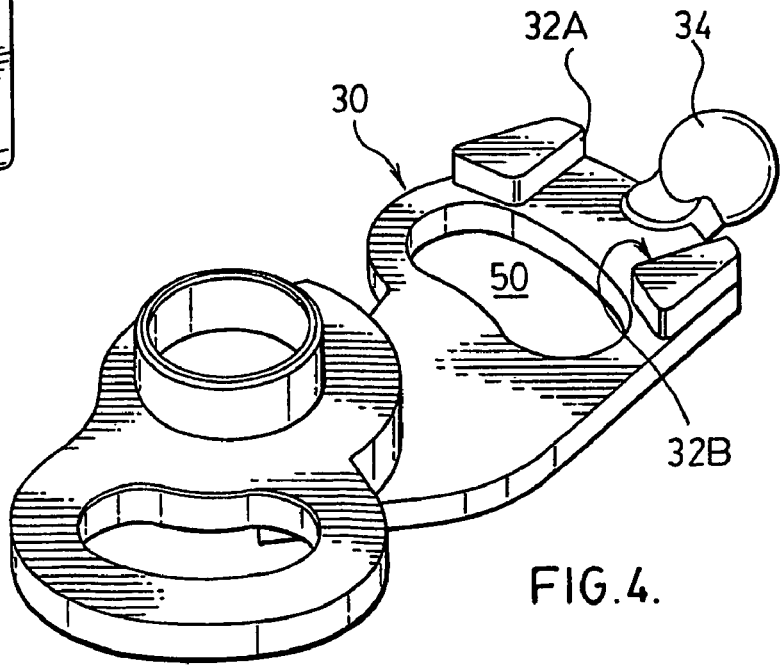
FIG. 4.

POWER ACTUATOR FOR DOOR LATCH

FIELD OF THE INVENTION

This invention generally relates to a power actuator for a vehicle door latch.

BACKGROUND OF THE INVENTION

Power lock mechanisms used in vehicles often employ an electric motor or actuator to move one or more lock levers between locked and unlocked positions. Typically, these latches are also equipped with a manual lock, typically an inside lock button and/or outside key cylinder. If the electric motor is constantly coupled with the lock lever(s) it has to be back-driven when the manual lock is operated. This adds to the effort required to actuate the manual lock and increases the noise of the locking/unlocking operation.

One solution to avoid back-driving the motor when the lock lever is manually operable is to equip the actuator with a return spring that automatically back-drives the motor to its initial position after each lock or unlock cycle. This allows for enough lost motion in the mechanism so that the next manual cycle can be performed without moving the motor. Alternatively, the lock actuator can include a clutch mechanism for disengaging the motor after each lock or unlock cycle. However, these solutions add parts, complexity, and costs to the lock actuator. For example, approximately 30% of the torque generated by the motor is often used to load the spring.

A similar problem arises in a power release application wherein, typically, a lever has to be actuated to move from a first position to a second position. For example, in a trunk release application, a motor is connected to an output arm which drives a release pall from a first position to a second position in order to release a trunk latch. In this case, the output arm is typically biased via a spring to cause the output arm to automatically return to its initial position in order to restart the sequence. Again, it would be desirable to actuate the output arm on the return stroke without having to backdrive the motor.

SUMMARY OF THE INVENTION

According to one aspect of the invention a power actuator assembly for a latch is provided which includes first and second articulated levers. The first lever includes at least one cam follower and the second lever includes a stop member which pivots between first and second positions as each lever travels between first and second positions. A motor-driven cam having at least one driving member and at least one cam stop member drives the first lock lever. More particularly, the driving member has a path of travel which is in engaging alignment with the cam follower for a portion of travel and is in disengaging alignment with the cam follower for another portion of travel. The cam stop member abuts the stop member of the second lever when the cam driving member is in the non-aligned position, whereby the levers may be activated without driving the cam.

Automotive latches generally have two articulated lock levers which are employed as the first and second levers of the actuator assembly when it is employed in a lock/unlock application. Generally speaking, a cam drives one of the lock levers while the other lock lever stops the cam in a position where manual locking/unlocking can be performed without back-driving the motor.

DESCRIPTION OF THE DRAWINGS

In drawings that illustrate the preferred embodiments of the present invention:

FIGS. 2A and 2B are perspective views of the cam of FIG. 1;

FIG. 3 is a perspective view of an inside lock lever of the assembly of FIG. 1;

FIG. 4 is a perspective view of an outside lock lever of the assembly of FIG. 1;

DETAILED DESCRIPTION OF PREFERRED EMBODIMENTS

Many automotive latches have two articulated lock levers—one lever connected to the outside lock and one for the inside lock. These levers are usually oriented along two orthogonal planes. Examples of such latches can be found in U.S. Pat. Nos. 5,899,508; 5,000,495; and 6,254,148.

The embodiment shown in FIGS. 1-6 employs a cam to drive one of the lock levers and the other lock lever to stop the cam in a position where manual locking can be performed without back-driving the motor.

Figure 1A:
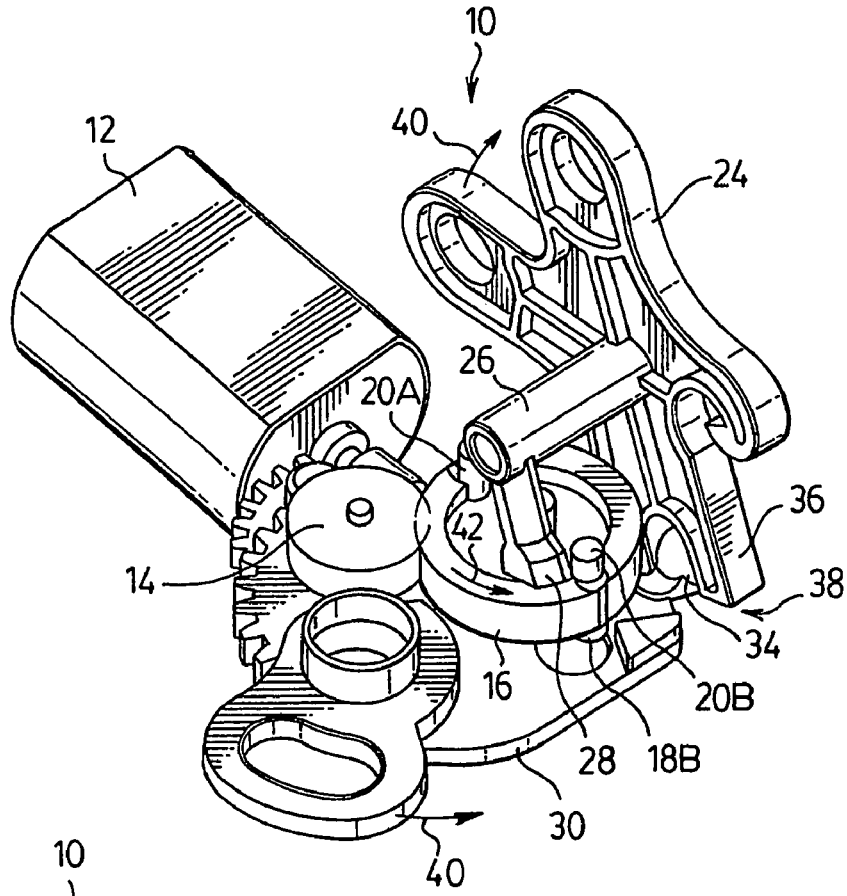
FIG. 1A is a perspective view of a power/manual lock actuator assembly of the present invention in a first operative position.
Figure 1B:
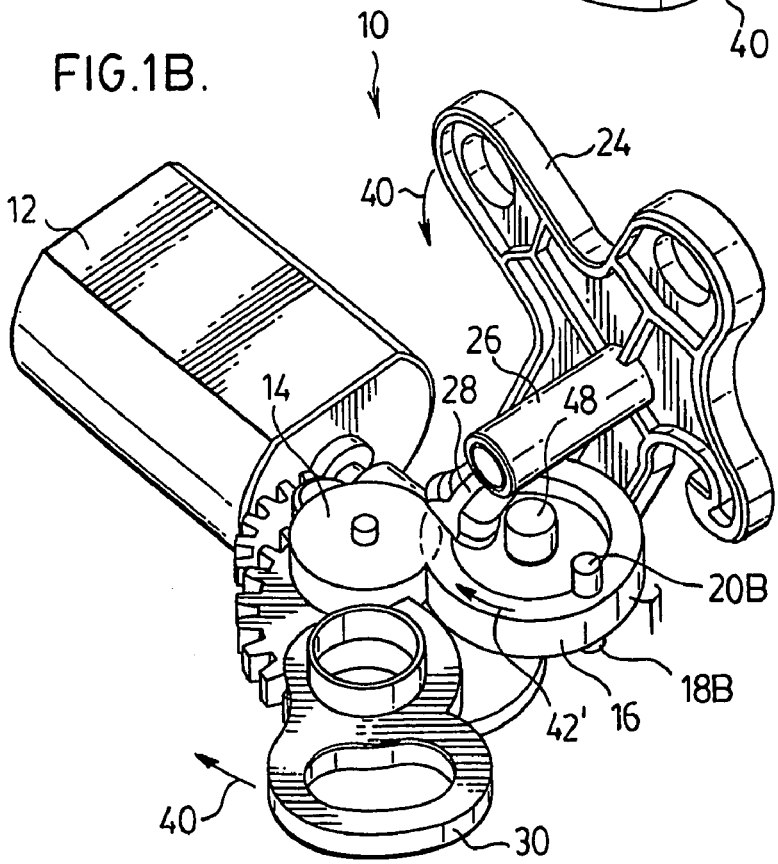
FIG. 1B is a perspective view of the actuator assembly of FIG. 1A in a second operative position.
Figure 5:
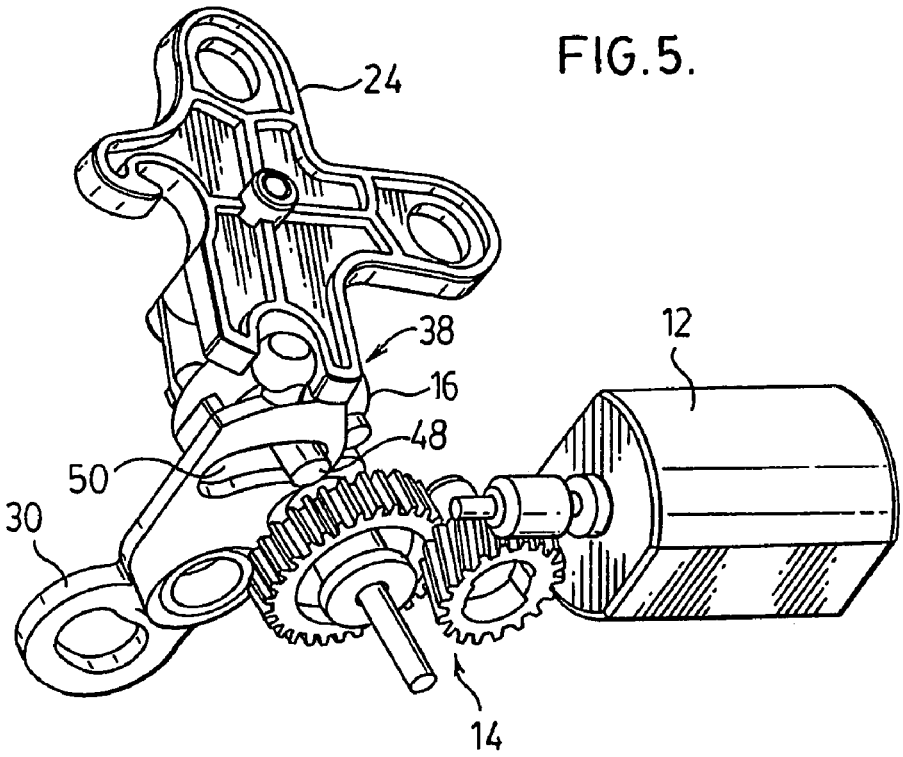
FIG. 5 is a perspective view of the lock actuator assembly from a reverse perspective from the view in FIGS. 1A & 1B.
Figure 6:
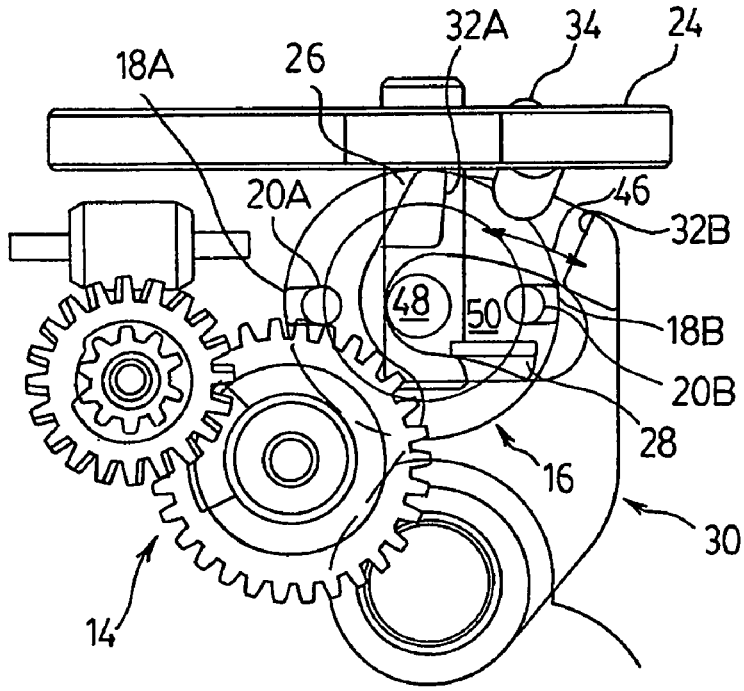
FIG. 6 a plan view illustrating the travel of the cam and outside lock lever of the embodiment of FIG. 1.

Referring to FIGS. 1A and 1B, the actuator assembly 10 of the present invention includes the following major components:

- a motor 12
- a gear train assembly 14
- a cam 16, having driving members 18A, 18B and cam stop members 20A, 20B
- a first (inside) lock lever 24, including a rocker 26 having a stop 28
- a second (outside) lock lever 30, including cam follower surfaces 32A, 32B (see FIGS. 4 and 6)

FIGS. 2A and 2B are isolated views of the cam 16 from opposing perspectives which show the cam stop members 20A, 20B (FIG. 2A) and cam driving members 18A, 18B in greater detail.

FIG. 3 is an isolated view of the inside lock lever 24. In this embodiment, lock lever 24 is intended for operative connection to an inside lock of the vehicle, i.e., the lock accessible from the interior of the vehicle.

FIG. 4 is an isolated view of the outside lock lever 30, including cam follower surfaces 32A, 32B. Lock lever 30 is intended for operative connection to an outside lock of the vehicle, e.g., a key cylinder accessible from the exterior of the vehicle.

Motor 12 is mounted on a latch (not illustrated) in a conventional manner. Motor 12 has a shaft having a pinion 13.

Gear train assembly 14 comprises a plurality of gears rotatably mounted relative to the latch in a conventional manner. The number and size of gears that are selected are utilized in a manner well known in the art.

Cam 16 is rotatably mounted relative to the latch. Cam 16 preferably rotates about an axis that is orthogonal to an axis of rotation of the motor shaft. Cam 16 is generally disc shaped, having a circular periphery with a series of teeth thereon for driving engagement with the gear train 14. As is apparent, driving rotation of the motor 12 rotates the cam 16.

Cam 16 has two opposite faces. On one face, cam 16 has a pair of driving members 18A and 18B that are diametrically opposed to one another. The opposite face has a pair of cam stop members 20A and 20B that are diametrically opposed to one another.

Inside lock lever 24 is pivotally mounted relative to the latch. Lock lever 24 pivots about an axis that is orthogonal to both the motor shaft axis and the cam axis. Normally, a mounting plate extends from the latch to facilitate mounting of the lock lever 24.

Inside lock lever 24 is conventionally shaped to provide operative connections to an inside locking mechanism and operatively connect to the latch. Inside lock lever 24 is pivoted with a stop member 28 that is connected thereto by a hollow shaft 26. Pivotal movement of the inside lock lever 24 responsively pivots the stop member 28 between first and second positions. Inside lock lever 24 also has a pair of feet defining a fork 36.

Outside lock lever 30 is pivotally mounted relative to the latch. Lock lever 30 pivots about an axis parallel to the axis of the cam 16. Outside lock lever 30 has a tab 31 that operatively connects the lever 30 to the outside locking mechanism, in a manner well known in the art. Outside locking lever 30 has an arm 33 extending from a collar 35, provided to facilitate the pivotal mounting. Located on the distal end of the arm 33 are opposed cam follower surfaces 32A and 32B. Additionally, a ball 34 extends from the arm 33.

Inside lock lever 24 is operatively interconnected with the outside lock lever 30 via ball 34 and fork 36 linkage 38. In the illustrated embodiment, the levers 24 and 30 are at one extremity of travel in FIG. 1A and at an opposite extremity of travel in FIG. 1B. Arrows 40 show the motions of the levers 24, 30 when actuated. Similarly, in FIG. 1A the cam 16 is at one extremity of its travel and FIG. 1B the cam is at an opposite extremity of its travel. Consequently in FIG. 1A the cam 16 rotates in a direction 42 and in FIG. 1B the cam 16 rotates in opposing direction 42'.

The motor 12 is actuated in one sense to drive the cam 16 in one direction and in the other sense to drive the cam 16 in the other direction, as explained in greater detail below.

In FIG. 6, the position of the cam 16 corresponds to that shown in FIG. 1A. In order to reach this position, the cam 16 and lock levers 24, 30 were initially in the position shown in FIG. 1B. The motor 12 is interconnected to the cam 16 via the gear train 14, so the motor is actuated to cause the cam 16 to rotate in direction 42' (FIG. 1B). As the cam 16 rotates, the cam driving member 18B engages the cam follower surface 32B of the outside lock lever 30 (as seen best in FIG. 6). The cam driving member 18B follows an arcuate path 42' defined by cam 16 and the cam follower surface 32B follows a different arcuate path 46 (See FIG. 6). Consequently, the cam driving member 18B eventually disengages from the cam follower surface 32B, as shown best in FIG. 6. As seen best in FIGS. 1A and 6, the cam 16 is prevented from further revolution by the cam stop member 20B which abuts the stop member 28 of shaft 26.

At this point, with the cam driving member 18B being in disengaged alignment with the outside lock lever 30, either lock lever 24, 30 (the two being articulated, as described above) is free to travel reversely (to the left in FIG. 6) without driving the cam 16. The housing, not shown, prevents the lock levers 24, 30 from continuing to travel along the arcuate path 46 (clockwise in FIG. 6). Consequently, the vehicle may be manually locked, or unlocked, as the case may be, without back driving the motor 12.

In one embodiment a sensor (not shown) may be employed to determine the position of the outside lock lever 30 relative to the cam 16. This enables control logic to determine the rotational sense required of the motor. Thus, for instance, if the levers 24, 30 are manually reversed in FIG. 6, the cam follower face 32A will be positioned adjacent to the cam driving member 18A. At the same time, due to the rigid connection between the rocker 26 and the inside lock lever 24, the rocker 26 pivots such that cam stop member 20A abuts stop member 28: On the next power cycle, the control logic actuates the motor 12 to drive the cam 16 clockwise in FIG. 6 such that cam driving member 18A engages cam follower surface 32B of the outside lock lever 30.

Alternatively, if the lock levers 24, 30 are not manually activated or are manually returned to the position shown in FIG. 6, on the next power cycle the control logic actuates the motor 12 to drive the cam 16 counterclockwise in FIG. 6. In this case, the cam driving member 18B engages cam follower surface 32A to reverse the lock levers 24, 30. Simultaneously, the rocker 26 pivots such that the cam stop member 20B abuts stop 28 as shown in FIG. 1B to prevent continued travel of the cam. The operation of the actuator 10 henceforth is similar to that already described with respect to the other operating position shown in FIGS. 1A and 6.

In an alternative embodiment the sensor can be omitted. If the device 10 is in the locked position and the motor is drive in the locking sense, the motor will stall since cam stop member 20A or 20B abuts the stop member 28 of rocker 26. Similarly, if the device 10 is in the unlocked position and the motor is driven in the unlocking sense, the motor will stall since earn stop member 20A or 20B abuts the stop member 28 of rocker 26.

The outside lock lever 30 includes a passage 50 sized to accept a shaft 48 of cam 16 without interference from the travel of the lock lever 30.

While the illustrated embodiment has shown the cam 16 driving the outside lock lever 30 and the rocker 26 connected to the inside lock lever 24, it will be appreciated that in the alternative the cam 16 can drive the inside lock lever 24 with the rocker 26 being connected to the outside lock lever 30.

The illustrated embodiment offers following advantages:

a) No additional parts are required—the inside lock lever 24, outside lock lever 30 and a power actuator such as the motor 12 and gear train 14 or a solenoid or pneumatic arrangement are part of the lock mechanism. The illustrated embodiment includes a novel arrangement forcing the levers 24 and 30 to stop at a desired position. No clutch part(s) has to be added.

b) Since a return spring is not used, full motor torque can be utilized for locking/unlocking instead of winding the spring.

c) The mechanical advantage changes with travel. At the beginning of travel where more force is needed the advantage is larger and at the end of the travel where a toggle spring (not shown) helps move the levers the ratio decreases. The toggle spring is positioned between one of the lock levers and the housing. The spring biases the lock levers to one of its two positions/extremities of travel, depending on position/extremity is closer. In conventional gear mechanisms the mechanical advantage ratio is constant throughout full travel.

FIGS. 7A-7D illustrate an alternative embodiment of the invention wherein the levers of the actuator assembly lie in the same plane. More specifically, these drawings show an actuator assembly 100 comprising a cam 102 having a plurality of pin-shaped cam driving members 104A . . . 104D (which, in the drawings, extend upward from the cam body) and a plurality wedge-shaped cam stop members 106A . . . 106D (which, in the drawings, extend downward from the cam body). A power actuator, not shown, engages the cam 102 to rotate it either clockwise or counterclockwise about axis 107.

The assembly 100 includes a first lever 108 that rotatably pivots about axle 110 and a second lever 112 that rotatably pivots about an axle 114. The first and second levers are articulated via a pin 116 extending from the first lever 108 that engages a slot 118 present in the second lever 112. The first lever 108 includes an arcuate-ridge cam follower 120, and the second lever 112 includes tabs 122A, 122B that function as lever stop members.

Figure 7A:
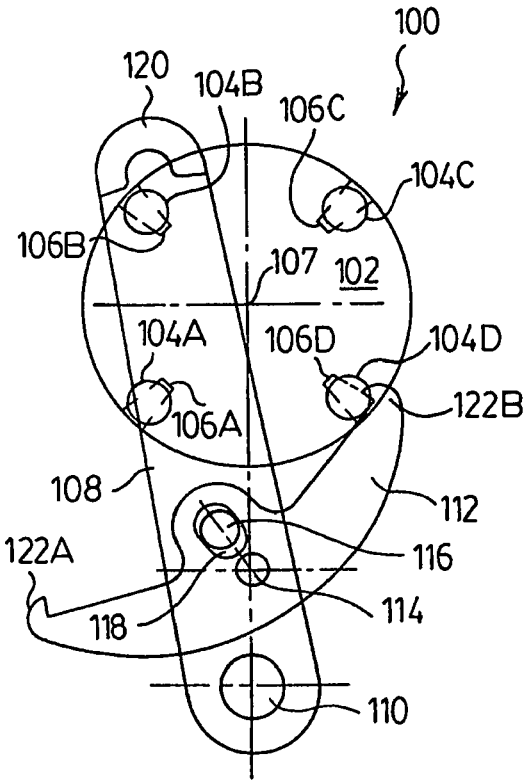
FIGS. 7A-E are schematic plan views illustrating the operation of a second embodiment of the invention.

In this embodiment the first lever 108 functions as an output lever and the second lever 112 functions to limit the travel of the first lever 108. More particularly, FIG. 7A shows the actuator assembly 100 in a first operative position wherein tab 122B abuts wedge-shaped cam stop member 106*d*. As a result of the articulated linkage between the first and second levers 108 & 112, the first lever 108 cannot be rotated counterclockwise in the drawing. However, as the pin-shaped cam driving member 104B is not in engaging alignment with the arcuate-ridge cam follower 120, the first and second levers 108 & 112 are free to be manually driven to a position shown in FIG. 7E, without having to actuate the cam 102 and thus without having to energize or backdrive the power actuator or motor.

Figure 7B:
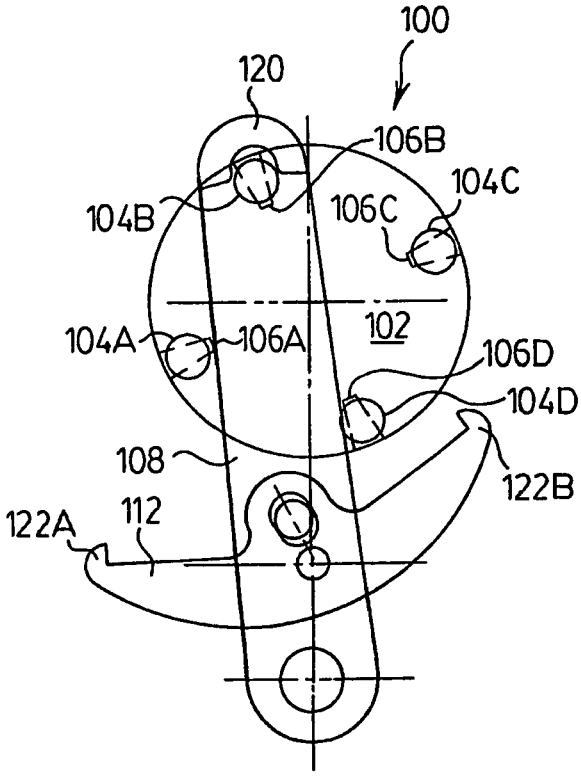
Figure 7C:
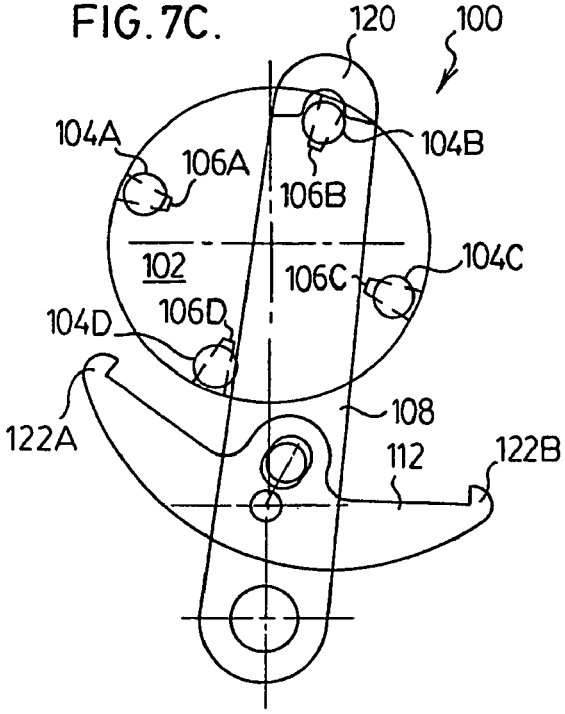
Figure 7D:
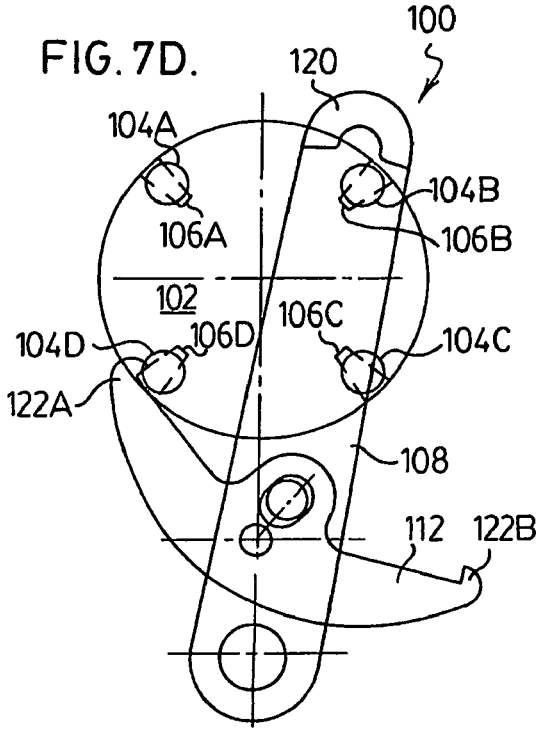
Figure 7E:
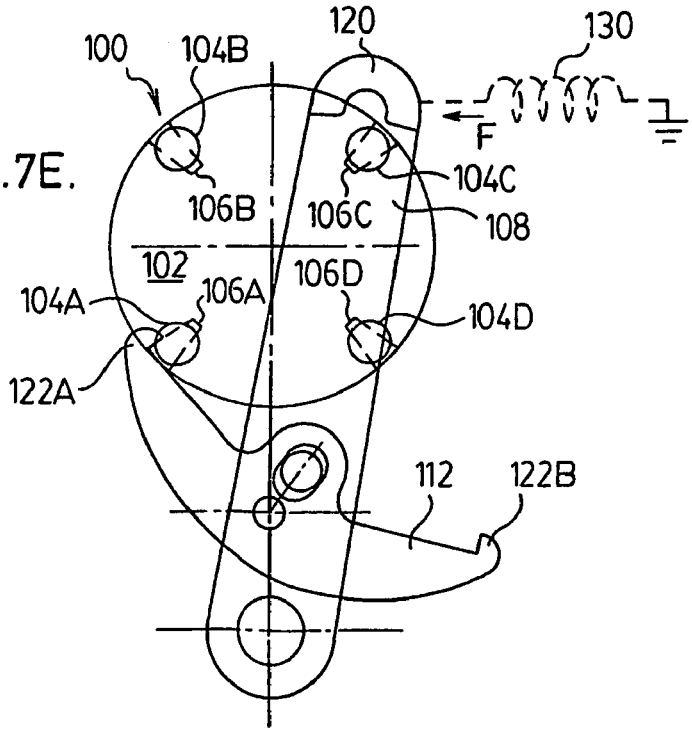

Referring back to FIG. 7A, the cam 102 may be actuated to rotate clockwise in the drawings. As seen in FIG. 7B, 7C & 7D, as the cam 102 is rotated, the pin-shaped cam driving member 104B has a path of travel which is in engaging alignment with the arcuate-ridge cam follower 120 for a portion of the travel path. More specifically, FIG. 7B and 7C show the pin-shaped cam driving member 104B engaging the arcuate-ridge cam follower 120, causing the first and second levers 108 & 112 to rotate clockwise toward a second position shown in FIG. 7D. In FIG. 7D, the pin-shaped cam driving member 104B is in a disengaged alignment with the arcuate-ridge cam follower 120. Contemporaneously, tab 122A abuts the wedge-shaped cam stop member 106D, preventing the first lever 108 from rotating clockwise any further yet enabling the first and second levers 108 & 112 to be manually driven in a counterclockwise direction without the necessity of actuating the cam 102.

The operation of the actuator assembly 100 is similar as the cam 102 is driven in the counterclockwise direction from the second position shown in FIG. 7D to the first position shown in FIG. 7A.

The actuator assembly 100 can be employed in a latch power lock/unlock application wherein the first, output, lever 108 is a lock lever (inside or outside). Alternatively, the actuator assembly 100 can be employed in a power release application wherein the first, output, lever 108 can be used to engage a pawl release lever. In this case, once the power actuator moves the first lever 108 to the second position, the first lever may be urged backed to the first position by a loaded spring 130, shown in phantom in FIG. 7E. In this application, because the cam 102 is always driven in one rotational direction, the cam driving members 104A . . . D serially drive the first lever 108 on subsequent cycles of operation.

Those skilled in the art will appreciate that a variety of modifications may be made to the embodiments described herein without departing from the spirit of the invention.

What is claimed is:

1. An actuator for a latch, comprising:

first and second levers disposed substantially orthogonal to one another and articulated via a ball and fork linkage, wherein said first lever includes at least one cam follower and said second lever includes at least one lever stop member which pivots between first and second positions as each of said first and second levers travel between first and second positions;

a cam having at least one cam driving member and at least one cam stop member;

a power actuator operatively engaging said cam effecting driving movement of said cam thereby moving said first and second levers between said first and second positions;

said at least one cam driving member having a path of travel which is in engaging alignment with said at least one cam follower for a portion of said travel and is in disengaging alignment with said at least one cam follower for another portion of said travel;

wherein said at least one cam stop member abuts said at least one lever stop member of said second lever when said at least one cam driving member is in said non-aligned position and wherein said first and second levers may be activated without driving said cam.

2. An actuator according to claim 1, wherein said at least one lever stop member comprises a shaft extending from said second lever in a direction substantially parallel to said first lever and wherein said shaft has an arm which pivots between said first and second positions.

3. An actuator according to claim 2, wherein said first lever is one of a latch inside or outside lock lever and said second lever is the other of said latch inside or outside lock lever.

4. An actuator according to claim 3, wherein said cam is rotatably mounted to a support and includes a toothed circumference in meshing engagement with a gear associated with said power actuator.

5. An actuator for a latch, comprising:

first and second articulated levers disposed substantially orthogonal to one another, wherein said first lever includes at least one cam follower and said second lever includes at least one lever stop member having a shaft extending from said second lever in a direction substantially parallel to said first lever and said shaft has an arm which pivots between first and second positions as each of said first and second levers travel between first and second positions;

a cam having at least one cam driving member and at least one cam stop member;

a power actuator operatively engaging said cam effecting driving movement of said cam thereby moving said first and second levers between said first and second positions;

said at least one cam driving member having a path of travel which is in engaging alignment with said at least one cam follower for a portion of said travel and is in disengaging alignment with said at least one cam follower for another portion of said travel;

wherein said at least one cam stop member abuts said at least one stop member of said second lever when said at least one cam driving member is in said non-aligned position and wherein said first and second levers may be activated without driving said cam.

6. An actuator according to claim 5, wherein said first and second levers are articulated via a ball and fork linkage.

7. An actuator according to claim 6, wherein said first lever is one of a latch inside or outside lock lever and said second lever is the other of said latch inside or outside lock lever.

8. An actuator according to claim 7, wherein said cam is rotatably mounted to a support and includes a toothed circumference in meshing engagement with a gear associated with said power actuator.

* * * * *

UNITED STATES PATENT AND TRADEMARK OFFICE

CERTIFICATE OF CORRECTION

PATENT NO. : 7,261,333 B2
APPLICATION NO. : 10/525084
DATED : August 28, 2007
INVENTOR(S) : Tomaszewski It is certified that error appears in the above-identified patent and that said Letters Patent is hereby corrected as shown below:

On the Title Page Item (57)
Please replace the Abstract with the following Corrected Abstract:

ABSTRACT

A power actuator assembly for a latch includes first and second levers articulated via a ball and fork linkage. The first lever includes a cam follower. The second lever includes a lever stop which pivots between first and second positions as the first and second levers travel between first and second positions. A cam has a cam driving member and a cam stop member. A power actuator operatively engages the cam to drive the cam. The cam driving member has a travel path engaged with the cam follower for a portion of the travel path and disengaged from the cam follower for another portion of the travel path. The cam stop abuts the lever stop when the cam driving member is in the disengaged position, whereby the first and second levers may be activated without driving the cam. The assembly can be employed in a lock or power release application.

Signed and Sealed this

Fourth Day of December, 2007

JON W. DUDAS
*Director of the United States Patent and Trademark Office*